US005871341A

United States Patent [19]

Melody

[11] Patent Number: 5,871,341

[45] Date of Patent: Feb. 16, 1999

[54] PERISTALTIC PUMP DRIVEN PUMP ROLLER APPARATUS AND METHODOLOGY

[76] Inventor: Brian J. Melody, 207 Roper Mtn. Ext., Greenville, S.C. 29615

[21] Appl. No.: 775,172

[22] Filed: Dec. 31, 1996

[51] Int. Cl.[6] ..... F04B 43/12

[52] U.S. Cl. ..... 417/477.6; 417/477.11

[58] Field of Search ..... 417/477.6, 477.11

[56] References Cited

U.S. PATENT DOCUMENTS

| | | | |
|---|---|---|---|
| 3,724,974 | 4/1973 | Molimard | 417/477.6 |
| 3,740,173 | 6/1973 | Natelson | 417/477.11 X |
| 3,749,531 | 7/1973 | Walker et al. | 417/477.6 X |
| 4,205,948 | 6/1980 | Jones | 417/477.6 |

FOREIGN PATENT DOCUMENTS

| | | | |
|---|---|---|---|
| 56-151289 | 11/1981 | Japan | 417/477.6 |
| 757838 | 9/1956 | United Kingdom | 417/477.6 |

*Primary Examiner*—Charles G. Freay

*Assistant Examiner*—Cheryl J. Tyler

*Attorney, Agent, or Firm*—Dority & Manning, PA

[57] ABSTRACT

A peristaltic pump is provided with drive gear mechanisms so that the pump rollers are respectively driven about their support axes in a rotatable direction opposite to that in which the support discs are driven. The result is that a forward motion is applied to fluid within the pump tubing while an opposite or rearward motion is applied to the tubing itself. The rate of the rearward motion may be controlled to be at least as great as, or greater than, the rate of the forward motion. The result is a reduction in the stretching forces otherwise applied to the consumable or replaceable length of pump tubing through which fluids are driven. The benefits from such result are increased life (i.e., usage time) for the length of pump tubing before it must be replaced, and simultaneously improved fluid delivery rate accuracy for a longer period of time as compared to the loss of accuracy which otherwise occurs due to tube stretching. Applying such methodology successfully improves tube life and enhances fluid delivery rate accuracy regardless of the type of tube material utilized, and regardless of the relative speed of operation (for example, high or low) of the pump.

23 Claims, 6 Drawing Sheets

PERISTALTIC PUMP DRIVEN PUMP ROLLER APPARATUS AND METHODOLOGY

BACKGROUND OF THE INVENTION

The present invention relates in general to improved apparatus and methodology for peristaltic pumps and in particular to improved pump roller drive mechanisms therefor resulting in improved pump tubing life and fluid delivery rate accuracy.

The basic design of typical conventional peristaltic pumps has been well-known and widely used to good advantage for many years. Such basic conventional design involves a length of pump tubing through which fluids to be pumped are received. Such tubing is typically resilient and pliable, and intended to be engaged by a plurality of pump rollers as the tubing is otherwise engaged against a rigid, curved backplate surface.

The pump tubing itself is regarded as being a consumable item, intended to be replaced as it "wears out."

Peristaltic pumps have been especially useful for many years in applications requiring relatively low fluid delivery rates and/or at relatively low pressures. Also, isolation of the fluid to be pumped in a pump tubing, generally without access thereto, helps prevent contaminating either the fluid or the pump itself. Such characteristic of isolated pumping ability is uniquely usable in certain applications, for example, if the material being pumped is chemically reactive or otherwise inherently dangerous.

Generally speaking, per the basic conventional design, fluid to be pumped enters one end of the pump tubing and is then advanced by progressive compression of the tubing between the rollers and the backplate surface. In essence, the fluid is advanced by being trapped in incremental amounts in the tubing between adjacent pairs of rollers, until it is forced through the entirety of the tubing by the action of the rollers and is expelled from an output end of the pump tubing.

Peristaltic pumps are generally very reliable due to their inherent simplicity. The fluid delivery rate itself is readily controlled through use of precision variable-speed electric drive motors.

Though generally simple in its basic design, peristaltic pumps are basically precision instruments of relatively higher costs, for example, costing possibly as much as $2000 to $2500 each.

The cost factor alone precludes use of peristaltic pumps in some applications, particularly where fluid isolation or delivery rate accuracy is not critical. However, the combination of their generally high reliability and the ease of flow rate control in otherwise demanding environments has resulted in the relatively wide spread use of peristaltic pumps in a number of stringent demand applications, such as for sample introduction into analytical instruments (e.g., ICP, DCP, Atomic Absorption, and the like), for the introduction of pharmaceuticals into intra-venous supply lines, and for the transfer of blood and/or other biological fluids. Peristaltic pumps are also often used for the introduction of fluids into chemical reaction vessels or similar arrangements, especially in small test bed or pilot plant operations, where critical controls and measurements are desired.

Despite their generally high reliability and accuracy, the performance of the pump is itself completely dependent on the performance of the pump tubing. "Wearing out" of a length of pump tubing occurs whenever the resilient, flexible pump tubing has excessively stretched due to its use. It is to be understood that the reaction of the rollers against the pump tubing is what actually performs the pumping work, and is also the source of the forces having a tendency to stretch the tubing during use. As a result of such stretching, the tubing internal diameter can be literally reduced in areas. Accordingly, the volume of fluid trapped between adjacent rollers can be correspondingly reduced.

In other words, in the face of such stretching, while the pump drive motor continues to operate at a highly accurate rate of turn, the progressive reduction in the tubing diameter and the consequential reduction in tubing volume between respective pairs of rollers, results in a progressive reduction in fluid delivery rate.

The above tube stretching phenomenon is therefore a significant drawback of typical conventional peristaltic pumps.

Another aspect of such phenomenon is that the progressive reduction in peristaltic pump delivery rate is particularly pronounced at relatively higher delivery rates. In other words, as a pump is run at relatively higher speed, such as between samples (to reduce instrument down-time between samples), the rate of undesired tube stretching increases.

Still another aspect of the undesired tube stretching phenomenon relates to the nature of the tubing material itself. In conventional practices, different tube materials are utilized for different applications. For example, silicone and fluoropolymer types of tubing may be typically used for chemically reactive and corrosive fluid pumping. However, such materials are relatively soft and mechanically weak, making them particularly susceptible to stretching damage. Such factor is especially a problem given the relatively higher costs of such types of tubing. Relatively less expensive vinyl tubing is generally less susceptible to stretching degradation (though stretching damage still occurs over time), but is not usable for certain applications, such as are the silicone and flouropolymer types of tubing, for handling particular fluids and/or operating in particular environments.

The bottom line for all basic designs of conventional peristaltic pumps is that there is a frictional drag between the pump rollers and the pump tubing, which results to a lesser or greater degree in undesired tube stretching. While the rate of such stretching varies with materials and/or pump operational speeds, the replaceable tubing (of basically any used material) is susceptible to such stretching damage, with commensurately reduced tubing life and degraded pump delivery rate accuracy.

SUMMARY OF THE INVENTION

The present invention recognizes and addresses various of the foregoing drawbacks, and others, concerning peristaltic pumps. Thus, broadly speaking, one main object of this invention is improved peristaltic pump apparatus and methodology.

It is another principal object of the present invention to provide peristaltic pump apparatus and methodology which relatively reduces the frictional drag between pump rollers and pump tubing. Hence, one more specific present object is to reduce undesired stretching of pump tubing of peristaltic pumps.

It is another broader object of the present invention to relatively improve tube life while simultaneously improving longer term consistency of fluid delivery rates for operation of peristaltic pumps at constant pump speeds. It is a more particular object to reduce stretching degradation of tubing and achieve more uniform flow rates, even at relatively higher speeds of operation.

Yet another present object is to obtain improved cost effectiveness for peristaltic pumps by improving pump tube performance, especially for tubing comprising relatively more expensive materials, by relatively lengthening the effective service times of such tubing.

It is a still further object of the present invention to provide improved apparatus and methodology which is applicable in a "retrofit" sense to the basic design of conventional peristaltic pumps, while being equally usable as incorporated into new peristaltic pump designs. It is a more particular object to provide such improved apparatus and methodology which is equally effective during any reverse operations of a peristaltic pump.

It is another present object to provide such improved apparatus and methodology which is equally applicable to variations in basic conventional pump designs, such as being usable with a number of different pump rollers, and with variation in the axial length of such pump rollers so that plural generally parallel lengths of pump tubing may be simultaneously used.

Additional objects and advantages of the invention are set forth in, or will be apparent to those of ordinary skill in the art from, the detailed description herein. Also, it should be further appreciated that modifications and variations to the specifically illustrated and discussed features, steps, materials, or devices hereof may be practiced in various embodiments and uses of this invention without departing from the spirit and scope thereof, by virtue of present reference thereto. Such variations may include, but are not limited to, substitution of equivalent means and features, materials, or steps for those shown or discussed, and the functional or positional reversal of various parts, features, steps, or the like.

Still further, it is to be understood that different embodiments, as well as different presently preferred embodiments, of this invention may include various combinations or configurations of presently disclosed features, elements, or steps, or their equivalents (including combinations of features or steps or configurations thereof not expressly shown in the figures or stated in the detailed description).

Once exemplary such embodiment of the present invention relates to a peristaltic pump with pump tubing anti-stretching features, comprising a pair of roller support discs, a curved backplate, a length of pump tubing, a drive motor, and various gear mechanisms associated with other components of the pump.

In such exemplary embodiment, the pair of roller support discs are preferably further provided with a plurality of respective support pins and with a corresponding plurality of pump rollers paired with and received on such support pins. The curved backplate is preferably relatively adjacent to but separated from the support discs so as to form a defined tubing gap. A length of pump tubing is removably received in such defined tubing gap. A drive motor is provided for controllably rotating such roller support discs in a defined forward rotatable direction for operation of the pump.

In the foregoing exemplary embodiment, the various gear mechanisms preferably include a plurality of spur gears associated respectively with the plurality of pump rollers. Such spur gears are each respectively associated with a ring gear, such that the pump rollers are respectively rotated in a defined rearward rotatable direction while the roller support discs are driven in the defined forward rotatable direction. Such mode of operation advantageously reduces stretching forces otherwise applied to the length of pump tubing during operation of the pump.

Another present exemplary embodiment concerns a peristaltic pump apparatus with plural drive means for improved pump tube life and greater pump accuracy, such apparatus including replaceable pump tubing means, rotatable support disc means, and primary and secondary drive means.

The above-referenced replaceable pump tubing means are provided for passing fluid therethrough during pump operations. The rotatable support disc means are provided for rotating during pump operations. Such disc means further include a plurality of respectively rotatable pump roller means supported thereon such that the outside diameters of the pump roller means are extendable beyond the disc means outside diameter. Such arrangement is for pumping action engagement of the pump roller means with the pump tubing means during pump operations.

The above-referenced primary drive means are provided for selectively rotating the rotatatable support disc means generally in a predetermined first rotatable direction. The secondary drive means are provided for respectively rotating the pump roller means generally in a predetermined second rotatable direction opposite to that of the first rotatable direction. With such functions, the fluid received in the pump tubing means receives applied motion in the first rotatable direction while the pump tubing means receives applied motion in the opposite second rotatable direction, advantageously resulting in reduced stretching of the pump tubing means.

While different embodiments may be practiced, in the foregoing embodiment, the support disc means may preferably include a plurality of respective support pins for receipt of the plurality of respective pump roller means, while the plurality of pump roller means may comprise respective annular elements received on respective of the support pins. In such instance, the annular elements preferably have outside diameters sufficient such that a portion of each of the outside diameters projects beyond the outside diameter of the support disc means.

Still further in such exemplary embodiment, in some constructions the primary drive means may include a central drive shaft associated with the support disc means, and further include motor means for selectively driving the central drive shaft. In such embodiment, the secondary drive means may include gear drive means associated with each respective pump roller means for rotating same.

In such exemplary gear drive means, a relatively larger, fixed gear ring may be included, also with a respective plurality of spur gears associated with each pump roller means, with such spur gears operatively associated with the gear ring, such that rotation of the central drive shaft of the primary drive means results in desired respective rotation of the pump roller means.

Yet another construction comprising a present exemplary embodiment includes an improved peristaltic pump, providing prolonged pump tube life and improved fluid delivery rate accuracy, including for example, at least one replaceable length of pump tubing, upper and lower support discs, a plurality of support pins, a corresponding plurality of generally circular pump rollers, a main pump body including a rotatable pump drive motor means, a generally rigid curved backplate, an internal ring gear relatively fixedly mounted on the main pump body, and a corresponding plurality of spur gears mounted respectively with the pump rollers. In such arrangement, the ring gear interacts with the respective spur gears, with the result that while fluid in the tubing is advanced in a predetermined first direction, an opposite direction force is applied to the tubing by rotation of the spur gears to reduce undesired stretching of the resilient tubing.

It is to be understood that various aspects of the present invention equally apply to methodology for improved pump tube life and pump fluid delivery rate accuracy for peristaltic pumps of the basic design generally described above, further practiced with pump roller drive features as discussed herein.

Those of ordinary skill in the art will better appreciate the features and aspects of such embodiments, methods, and others, upon review of the remainder of the specification.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
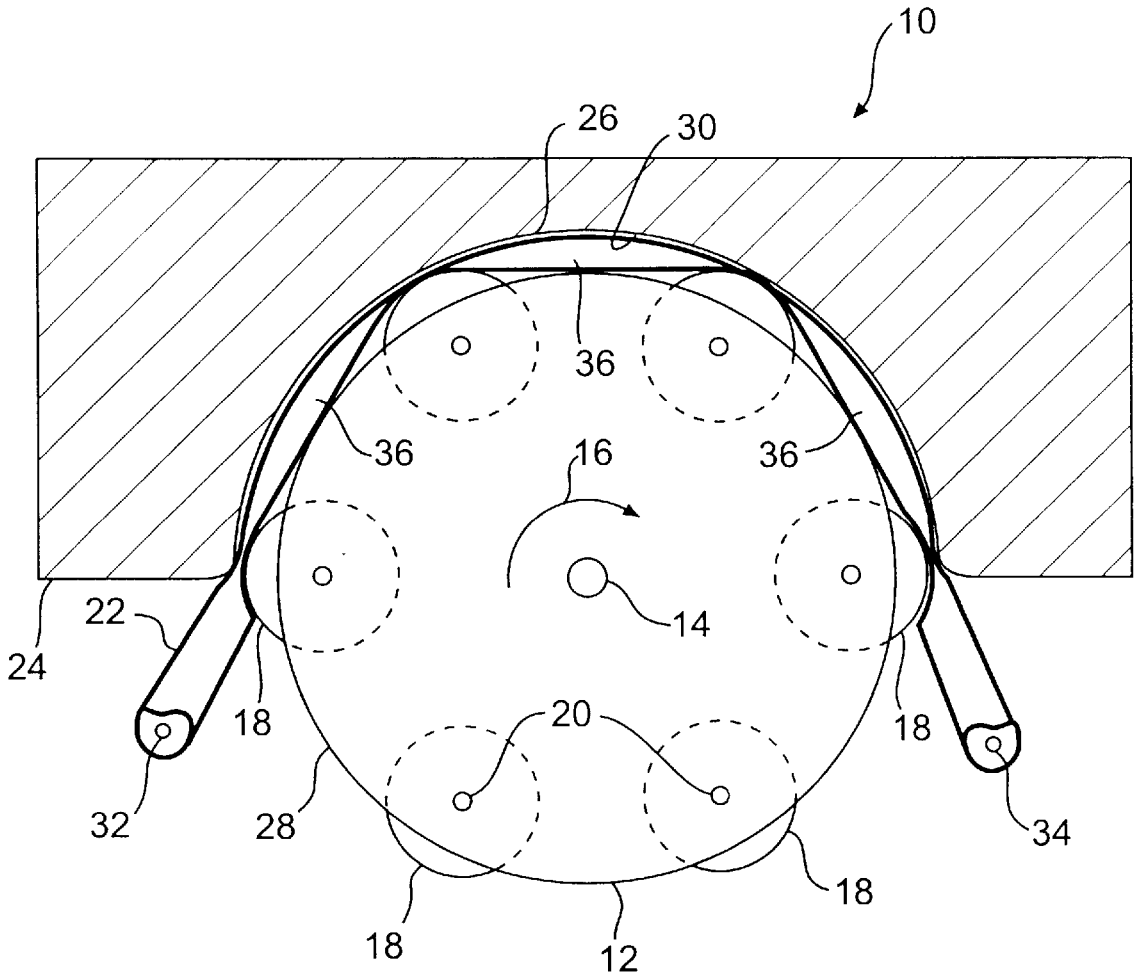
FIG. 1 PRIOR ART
FIG. 1 is a top plan view, with partial cross sectional illustration, of a typical basic design of a convention peristaltic pump, with a relatively new length of pump tubing incorporated therein.

Repeat use of reference characters throughout the present specification and appended drawings is intended to represent same or analogous features, elements, or steps of the invention.

DETAILED DESCRIPTION OF THE PREFERRED EMBODIMENTS

Reference will now be made in detail to the presently preferred embodiments of the invention, including both apparatus and methodology, examples of which are fully illustrated in the accompanying drawings. Each such example, and each such drawing, is provided by way of an explanation of the invention, not limitation of the invention. In fact, it will be apparent to those skilled in the art that various modifications and variations can be made in the present invention. For instance, features illustrated or described as part of one embodiment may be used with another embodiment. Additionally, certain features may be interchanged with similar devices or features not mentioned, yet which perform the same or similar function. Thus, it is intended that the present invention covers such modifications and variations as come within the scope of the appended claims and their equivalents.

Figure 2:
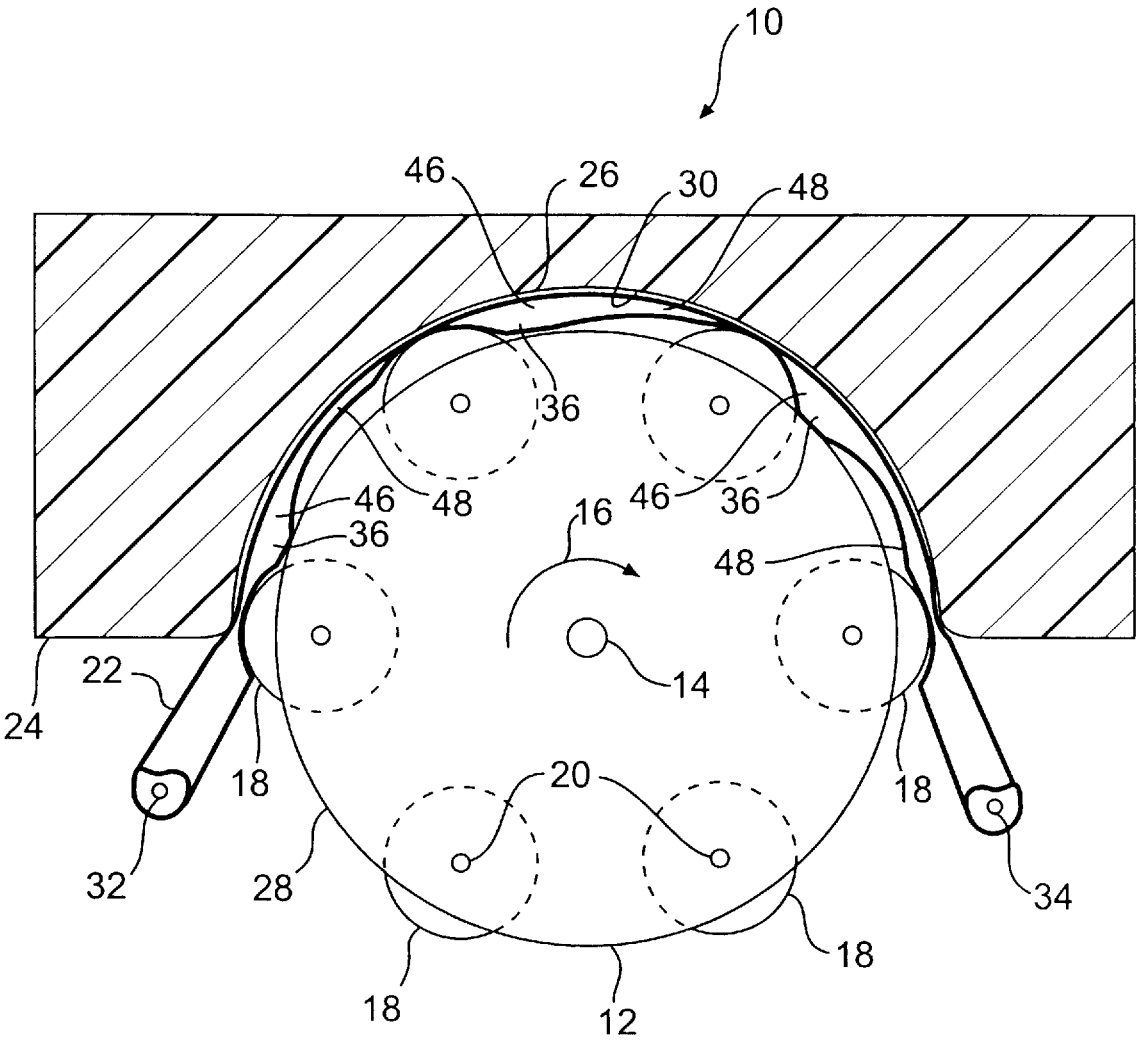
FIG. 2 PRIOR ART
FIG. 2 is the same view as shown in present FIG. 1, but after a period of use of the pump tubing, representing stretching distortion of such pump tubing as a result of its use.

As discussed in the summary of the invention, the present invention is particularly concerned with a reduction in the frictional drag between pump rollers and pump tubing which otherwise occurs in the typical basic designs of conventional peristaltic pumps. FIGS. 1 through 4 herewith expressly represent such typical conventional or prior art type devices. One exemplary manufacturer of such conventional devices is Gilson Medical Electronics of Middleton, Wis. It is to be understood that components and details of various conventional designs may vary, though all are intended to be represented by the present exemplary figures. For example, FIGS. 1 and 2 represent six pump rollers. Different numbers of pump rollers may be practiced, for example with Gilson Medical Electronics providing at least one commercial device having ten such rollers.

FIG. 1 shows a top plan view with partial cross section of the basic functional components of a typical design of a conventional peristaltic pump generally 10. A top roller support disc generally 12 is adapted to be driven by a common drive shaft generally 14 in a predetermined first or generally forward rotatable direction, as represented by curved arrow 16. Common drive shaft 14, in turn, is connected to an electrical motor means (not seen in this view) situated beneath top roller support disc 12 and beneath a further lower roller support disc (also not seen in this view).

A plurality of pump rollers 18 are received on a corresponding plurality of support pins 20, which in turn are supported by upper support disc 12 and the lower support disc (not seen in these views). In such conventional arrangement, as support disc 12 is rotated in forward rotatable direction 16, pump rollers 18 are in a free wheeling arrangement so as to be rotated literally by frictional engagement with the sacrificial pump tubing generally 22.

As further represented by present FIG. 1, and as understood by those of ordinary skill in the art, pump 10 may be provided with a generally rigid, curved backplate generally 24. Backplate 24 may have a curved arrangement, such as generally semi-circular, concave curvature 26. As shown, the concave curvature generally 26 is situated adjacent to but relatively removed from the outside diameter generally 28 of support disc 12. As a result, a tubing gap generally 30 is defined between backplate curvature 26 and disc outside diameter 28.

As represented, pump tubing 22 is situated so as to reside in such defined tubing gap generally 30. As also represented, the respective diameters of the annular members comprising pump rollers 18 are selected to be sufficient so that (as shown) a portion of the outside diameters of such pump rollers 18 (when rollers 18 are situated on their respective pins 20) projects or extends beyond the outside diameter 28 of disc 12. With such arrangement, fluid entering input end generally 32 of pump tubing 22 passes through an intermediate portion of such tubing (the tubing within defined tubing gap 30) until being expelled by operation of pump 10 at a tubing output end generally 34.

As well understood by those of ordinary skill in the art, fluid is drawn into pump 22 at end 32 thereof, and massaged or advanced within pump tubing 22 by the formation of fluid entrapment areas generally 36. A plurality of such fluid entrapment areas 36 are formed between adjacent pairs of the pump rollers 18 situated in, and advancing through, the defined tubing gap 30.

Figure 3:
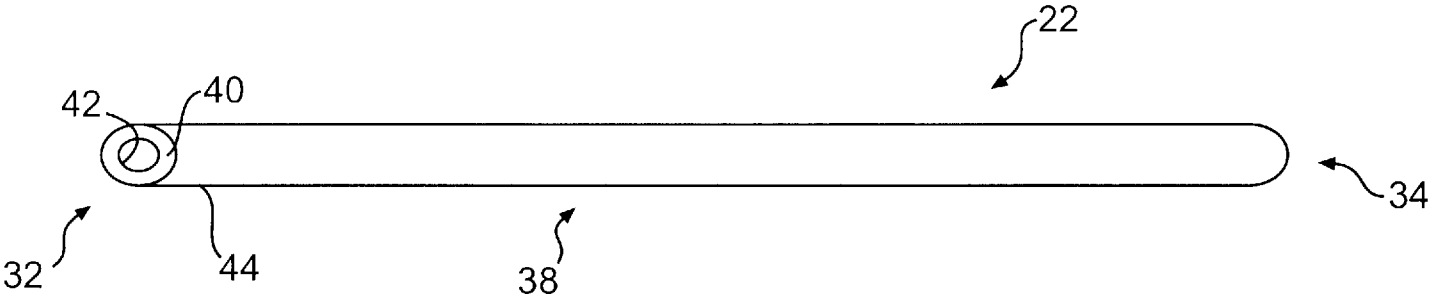
FIG. 3 PRIOR ART
FIG. 3 is a generally top plan view with partial cross section of a length of conventional pump tubing prior to use thereof.

FIG. 3 represents a typical conventional length of pump tubing 22 as may be removably (i.e., sacrificially) used with a conventional device such as represented in present FIG. 1. While different materials may be practiced, as understood by those of ordinary skill in the art, generally tubing 22 has an input end 32 and an output end 34 with an intermediate region generally 38 to be entrained in the tubing defined region 30 for the advancement of fluids therethrough. A preselected tubing wall thickness generally 40 results in a preselected original inside diameter generally 42 and outside diameter generally 44 of such tubing 22.

FIG. 1, in general, represents inclusion and use of a fresh or relatively unused pump tubing 22, as is represented by present FIG. 3. Generally speaking, FIG. 2 is identical to the representations of present FIG. 1, but further representing the condition of tubing 22 after significant use thereof. The representation reveals the eventual stretching degradation which takes place, resulting in distortion of the tubing 22, as depicted. Particularly as represented in fluid entrapment areas 36, the normally resilient and pliable tubing stretches out of its original shape due to the frictional engagement forces with the respective outside diameters of the plurality of pump rollers 18.

While the exact stretching phenomena may vary with different tubing materials and under different operational circumstances, FIG. 2 represents a relative enlargement generally 46 and a corresponding relatively reduced area 48 which progresses through defined tubing gap 30 between each of the progressing fluid entrapment areas 36 as they move in the predetermined first or defined forward rotational direction 16.

Figure 4:
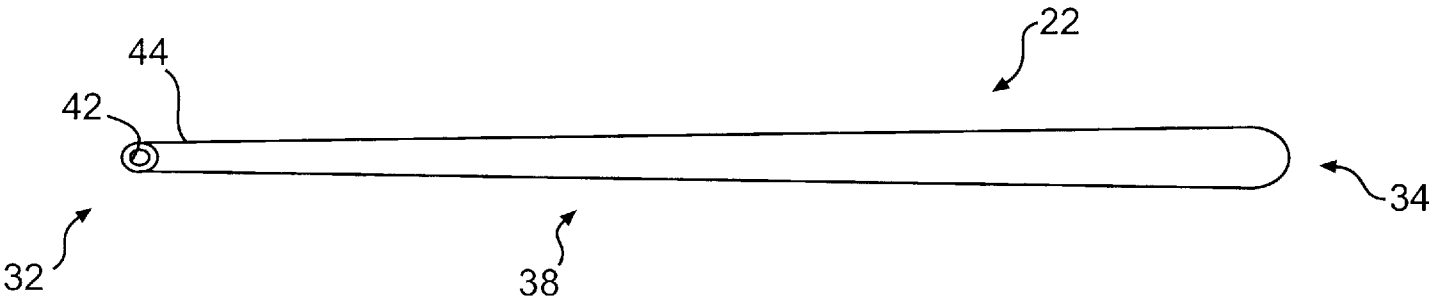
FIG. 4 PRIOR ART
FIG. 4 is generally the same view as present FIG. 3, but after a period of use of such pump tubing, representing stretching degradation of such pump tubing.

Over sufficient time, the tubing 22 generally becomes stretched towards its output end 34 (assuming operation in the rotatable direction 16). As represented by FIG. 4, such used or "worn out" tubing 22 is distorted by such stretching to the point that the inside diameter 42 and outside diameter 44 relatively adjacent input end 32 have been reduced. Moreover, as represented by present FIG. 4, such inside and outside diameter characteristics vary at any point along the length of tubing 22.

As should be understood from the fixed spacing of pins 20 and corresponding pump rollers 18, the fluid delivery rates will degrade or vary (generally decreasing) over time if the rate of pump operation (turning of drive shaft 14) is held constant. Thus, FIGS. 2 and 4 illustrate and represent the physical tubing degradation which occurs from stretching under free wheeling frictional engagement of pump rollers 18 with pump tubing 22, and the resulting degraded pump delivery rate accuracy is to be understood therefrom.

The above-described tube stretching phenomenon has been found to occur especially as the pump is operated at relatively high speeds and/or with relatively soft tubing, such as silicone or fluoropolymer tubing. It has also been found to occur with otherwise relatively distortion-resistant tubing such as vinyl tubing, especially at sufficiently high pump speeds.

A comparison of FIGS. 3 and 4 (in effect, "before" and "after" views) shows in isolation the stretching degradation which eventually occurs in virtually all situations, regardless of the tubing material utilized and/or the speed of pump operation. For clarity in revealing such comparison, conventional stops used to mount such tubing 22 in the pump are not shown in FIGS. 3 and 4.

Figure 5A:
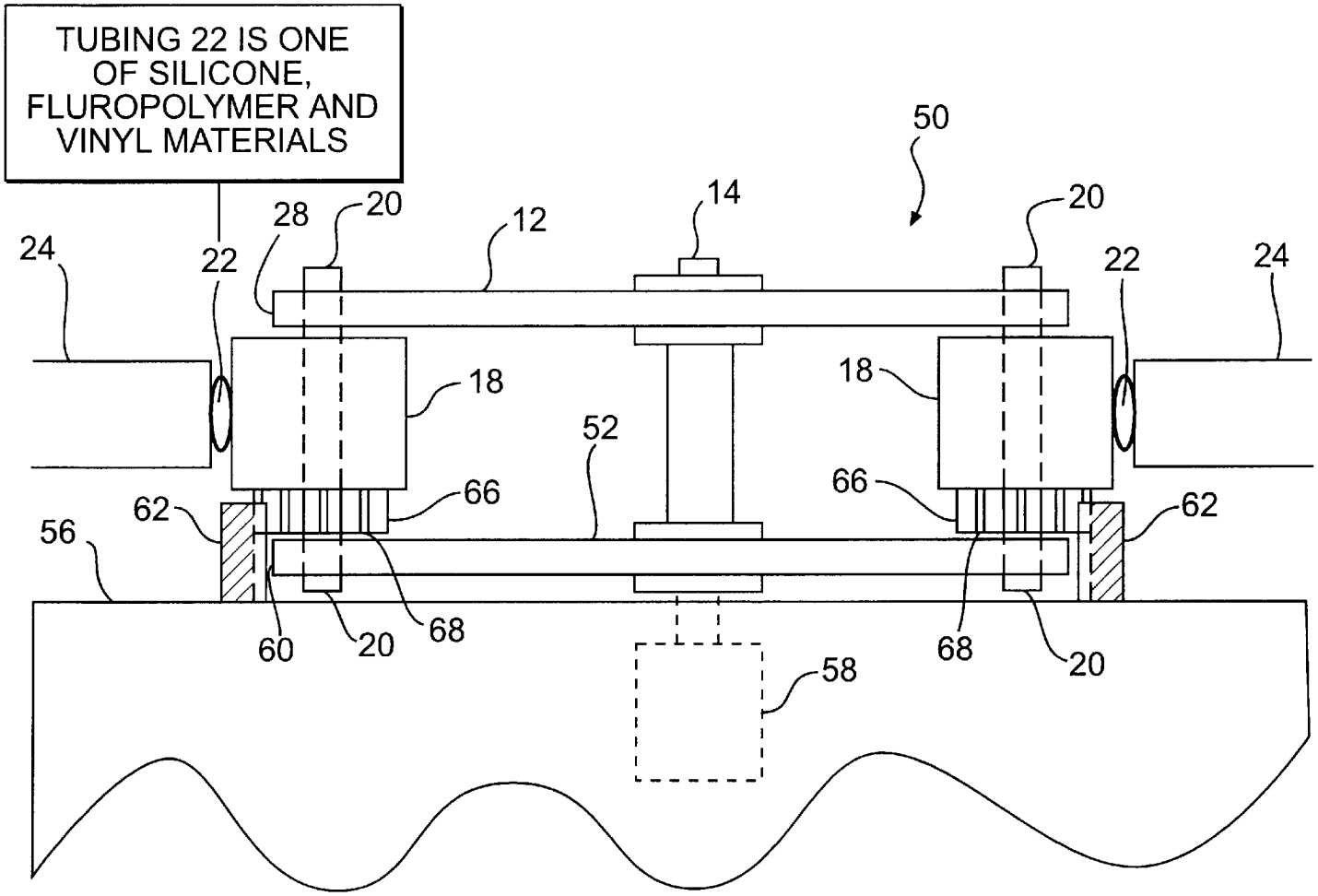
FIG. 5*a* is a generally front view of an exemplary embodiment of the present invention, with partial cross section and cutaway illustrations.

FIG. 5*a* represents a generally front view of an exemplary embodiment of the subject invention generally 50, with partial cross sectional and cutaway illustrations. Such embodiment generally 50 comprises a peristaltic pump with pump tubing anti-stretching features. It particularly incorporates mechanisms and features for controlled rotation of the pump rollers, rather than the free wheeling conventional arrangement described above.

It is to be further understood that the presently described features of pump 50 may be practiced in conjunction with various of the conventional components referenced above with conventional pump 10. Accordingly, repeat use of like reference characters is intended to represent same or analogous features or elements.

Figure 5B:
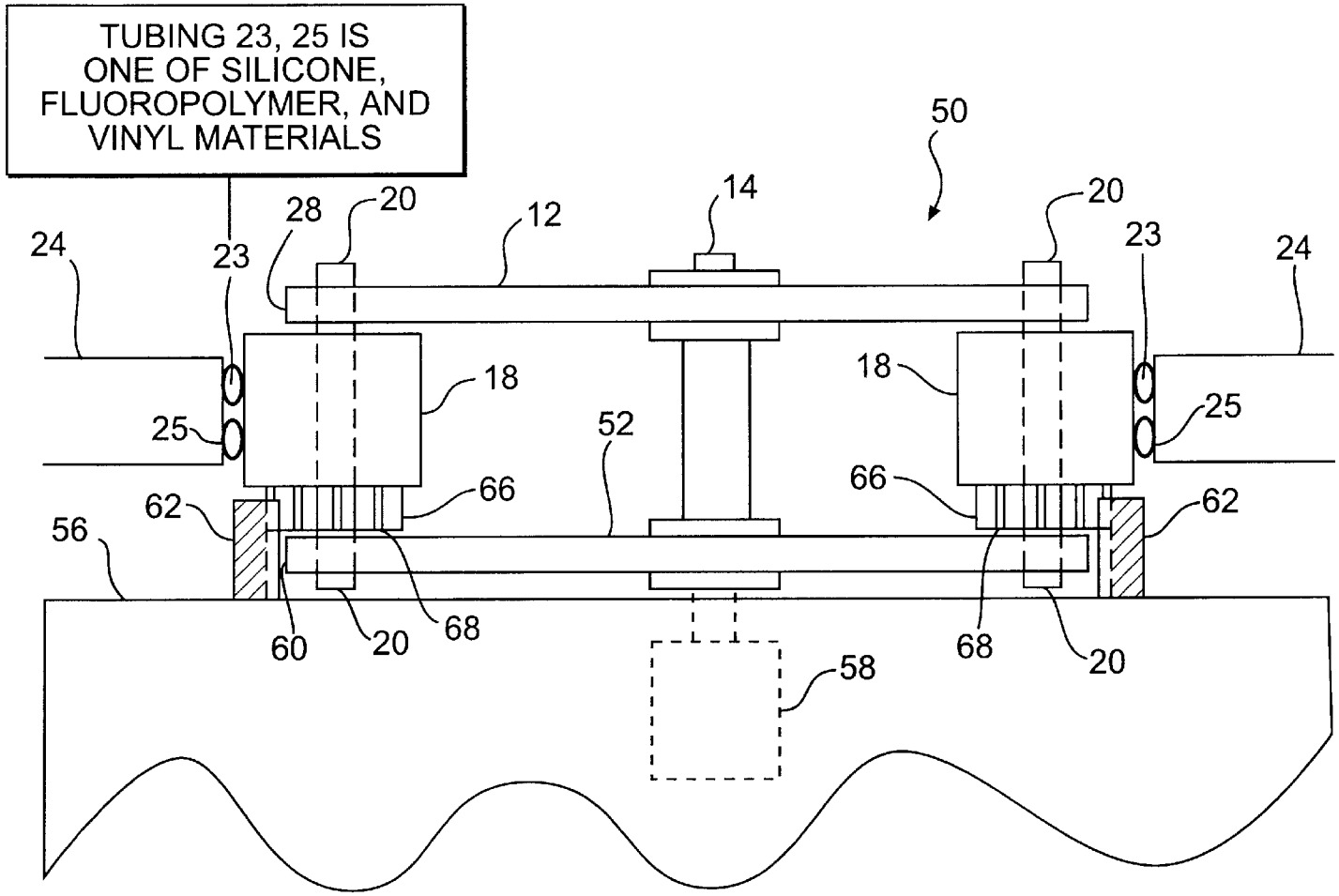
FIG. 5*b* is a generally front view of a second exemplary embodiment of the present invention, showing an optional two pump tubing arrangement.
Figure 6:
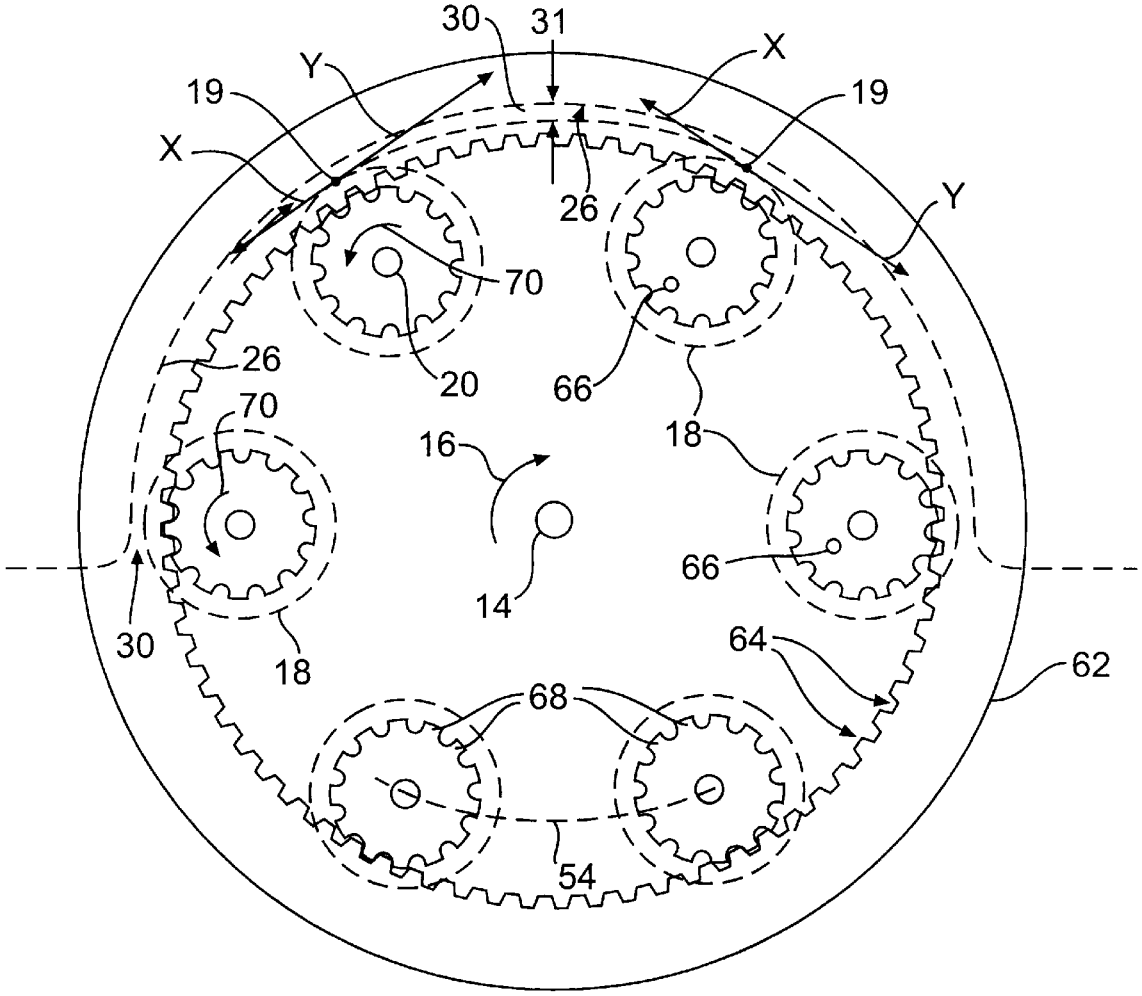
FIG. 6 is a partial generally top view of the present exemplary embodiment of the subject invention as represented in FIG. 5, focusing primarily on a gear arrangement or secondary drive means thereof.

Discussed in conjunction with FIG. 5 additionally is FIG. 6, a generally partial top view of the embodiment of present FIG. 5, representing primarily the gear arrangement thereof, as discussed in greater detail herein.

With reference to such FIGS. 5*a* and 6, at least one replaceable length of resilient and pliable pump tubing 22 is situated in defined tubing gap 30 such that fluids are to be advanced therein in a predetermined first rotational direction generally 16 by operation of pump 50. Such pump tubing 22 has respective input and output ends, just as represented in present FIGS. 1 and 2, and likewise has a defined intermediate portion between such ends situated in the defined tubing gap 30, and adapted to be engaged for fluid advancement.

Separate upper and lower support discs 12 and 52 are mounted respectively generally in parallel on the central pump drive shaft 14. They are adapted to be rotatably driven, such as in the predetermined first rotatable direction 16.

Particularly as represented by FIG. 5*a*, a plurality of support pins 20 are received between support discs 12 and 52. Preferably, they are relatively spaced generally equidistantly about a support pin circle 54 (FIG. 6) generally concentric with and adjacent to the outside diameters of the respective support rollers 18. Such support pin circle is represented by an imaginary dotted line 54 in FIG. 6, simply running through the central axis points of the respective support pins 20.

As further represented in present FIGS. 5*a* and 6, a corresponding plurality of generally circular pump rollers 18 are received respectively on the support pins 20. They are each of respective diameters sufficient such that portions of each of their respective outside diameters project beyond the outside diameters 28 and 60 respectively, of the support discs 12 and 52, as best represented in present FIG. 5.

A main pump body generally 56 is represented in partial cutaway in present FIG. 5*a*. Included therein is a rotatable pump drive motor means generally 58 (diagrammatically represented in dotted line in present FIG. 5), which is coupled with the central pump drive shaft 14 for rotating same.

Again, similar to the construction of present FIGS. 1 and 2 with regard to certain specific components, a generally rigid curved backplate 24 may be provided. It preferably has a generally semi-circular concave curvature 26 (FIG. 6) situated relatively adjacent to the outside diameters 28 and 60, respectively, of discs 12 and 52. Curvature 26 is separated at a predetermined curve distance from such outside diameters so as to form a predetermined curved gap 30 between the concave curvature 26 and the outside diameters of the pump rollers for receipt of the intermediate portion of the pump tubing 22. In such fashion, respective entrapment areas of the tubing are again formed between adjacent respective pairs of the pump rollers as are in contact with tubing 22 within defined tubing gap 30. See particularly the discussion set forth with respect to fluid entrapment areas 36 of present FIGS. 1 and 2.

The following more particularly describes features of the present embodiment, such as may be retrofit to conventional pump designs, or included in original constructions thereof, so as to provide the otherwise free wheeling pump rollers with secondary drive means so that they are respectively rotated in a rotatable direction generally opposite to that of the rotatable drive direction of shaft 14.

Specifically, an internal ring gear generally 62 is relatively fixedly mounted, preferably on main pump body 56. It is provided with a plurality of inside diameter gear teeth 64 which have a preselected pitch. As represented, the total inside diameter of ring gear 62 is greater than the diameter of the support pin circle generally 54.

In accordance with the invention, ring gear 62 functionally cooperates with a corresponding plurality of spur gears generally 66 mounted respectively with the plurality of pump rollers 18. As represented, each spur gear 66 has its own set of outside diameter gear teeth generally 68, also of preselected pitch. As represented, such outside diameter gear teeth 68 of the spur gears 66 preferably are positioned to mesh with the inside diameter gear teeth 64 of ring gear 62. With such an arrangement, the respective pump rollers 18 are rotatably driven about their respective support pins generally 20 in a rotatable direction 70 generally opposite to that of the predetermined first rotatable direction 16, whenever the pump drive motor means 58 rotates the central pump drive shaft 14 in such predetermined first rotatable direction 16.

With the foregoing arrangement, fluid in the intermediate portion of the tubing 22 is advanced in such predetermined first rotatable direction generally 16 while advantageously an opposite direction force (rotatable direction 70) is supplied to tubing 22 so as to reduce undesired stretching of such resilient tubing 22.

It is to be understood from the present disclosure that the design of the ring gear 62 and spur gears 66 may be selected such that relative speed of the motion applied to the tubing 22 is at least equal to the speed of the motion applied to the received fluid (see radically outer point 19 of rollers 18 in FIG. 6). More preferably, the design is selected such that the speed of the motion applied to the tubing (arrow X in FIG. 6) is greater than that applied to the received fluid (arrow Y in FIG. 6), such as five to ten percent greater, to ensure the desired anti-stretching advantages described above.

Additional features may be practiced or are to be understood, either as originating from the subject invention directly, or as embodiments which make further use of conventional features combined therewith in the creation of new embodiments. For example, the size of defined tubing gap 30 may be varied, to accommodate different tubing members which might be utilized, and to facilitate introduction and removal of tubing elements. See double-headed arrow 31 of FIG. 6 graphically representing the adjustable tubing gap 30.

Regardless of such variations and modifications, the essence is maintained whenever one directional motion (such as forward) is applied to the fluid while the opposite directional motion (such as rearward) is applied to the tubing. With the pump roller rotation positively controlled (for example, such as through the use of the illustrated gearing), the frictional drag force against the pump tubing is minimized and the corresponding stretching degradation of the pump tubing and resulting drift in fluid delivery rate is likewise minimized.

For example, with more "exotic" materials needed to handle for example, highly corrosive materials, as much as 20 minutes time may be needed for break in of new incorporated pump tubing, but with a resulting failure of such tubing after only two hours of operation. The presently achieved resulting improvements in the life of conventional pump tubings not only saves time during operation, but reduces the down time needed to change installed tubing.

It is to be further understood that the present methodology and apparatus is equally applicable to other variations. For example, the axial length of pump rollers 18 may be extended beyond that shown such that additional lengths of tubing may be situated in parallel, so that simultaneous plural "channels" of isolated pump lines may be operative during operation of the pump. See representative alternative plural pump lines 23 and 25 shown in FIG. 5*b*. The number of pump rollers themselves may be varied, for example, within a range of from about four to about twelve pump rollers, or other numbers may be practiced, preferably spaced relatively equidistantly about the roller support discs.

In still further terms, the present invention as to both apparatus and methodology may be otherwise understood as providing plural drive means in a peristaltic pump arrangement for improved pump tube life and greater pump accuracy through reduced stretching degradation. A primary drive means is provided by the subject invention for selectively rotating the rotatable support disc means generally in a predetermined first rotatable direction thereof, such as arrow 16. In such context, the discussed and illustrated gearing arrangement may comprise secondary drive means for respectively rotating the pump roller means generally in a predetermined second rotatable direction thereof (such as arrow 70) opposite to that of the first rotatable direction generally 16.

With the foregoing arrangement, fluid received in the pump tubing means receives applied motion in the first rotatable direction 16 while the pump tubing means itself receives applied motion in the opposite second rotatable direction generally 70. The advantageous result is the reduced stretching of the pump tubing means, as discussed above. In the present example, such secondary drive means may include specific gear drive means associated with each of the respective pump roller means for rotating same, or other secondary drive arrangements.

Considered more broadly, in the context of the present methodology, the pump rollers are driven for rotation about their respective pins or axes in a rotational direction opposite to that in which the roller discs are driven during operation of the pump. With such methodology, in accordance with the invention, one direction of motion is applied to the fluid received in the tubing while an opposite direction of motion is applied to the tubing to reduce stretching thereof.

It is to be understood that both apparatus and methodology disclosed herein functions regardless of the direction of operation of pump 50. In other words, if shaft 14 is rotated is a direction opposite to rotatable direction 16, then pump rollers 18 will automatically likewise be rotated in a direction opposite to rotational direction 70, so as to maintain the preferred relationship described above for the two relative motions applied respectively to the fluid and to the tubing.

While particular embodiments of the invention, both apparatus and methodology, have been described and shown, it will be understood by those of ordinary skill in the art that the present invention is not limited thereto since many modifications may be made. Additionally, equivalent devices, steps, or methods may be employed for practicing the present invention. Therefore, it is contemplated by the present application to cover any and all such embodiments that may fall within the scope of the invention and the appended claims.

What is claimed is:

1. A peristaltic pump with pump tubing anti-stretching features, comprising:

a pair of roller support discs mounted for rotation about a shaft, a plurality of respective support pins and with a corresponding plurality of pump rollers paired with and received thereon being mounted between said support discs, said pump rollers each having an outer surface;

a curved backplate relatively adjacent to but separated from said support discs so as to form a defined tubing gap;

a length of pump tubing removably received in said defined tubing gap;

a drive motor for controllably rotating said roller support discs about said shaft in a defined forward rotatable direction; and a gear train driven by said drive motor for rotating said pump rollers about corresponding support pins in a defined rearward rotatable direction so that a rearward tangential speed of a radially outer point on said outer surface of each said pump roller due to rotation of the pump roller around its pin is greater than a forward tangential speed of said radially outer point due to rotation of said roller support discs around said shaft.

2. A peristaltic pump as in claim 1, wherein said gear train includes a ring gear generally fixed relative to said roller support discs and a plurality of spur gears, each associated with one of said pump rollers, said ring gear including inside diameter gear teeth which drivingly intermesh with outside diameter gear teeth of each of said spur gears.

3. A peristaltic pump as in claim 1, wherein said pump tubing comprises resilient, pliable material.

4. A peristaltic pump as in claim 1, wherein said pump tubing comprises one of silicone, fluoropolymer, and vinyl materials.

5. A peristaltic pump as in claim 1, wherein:

the number of said plurality of pump rollers is within a range of from about 4 to about 12 pump rollers spaced relatively equidistantly about said roller support discs; and the position of said curved backplate relative to said support discs is adjustable so as to correspondingly adjust the size of said defined tubing gap.

6. A peristaltic pump as in claim 1, further including a plurality of lengths of pump tubing, removably received in said defined tubing gap for establishing a corresponding plurality of isolated pump lines simultaneously operative during operation of said pump.

7. A peristaltic pump as in claim 1, wherein said rearward tangential speed is about 5 to 10 percent greater than said forward tangential speed.

8. A peristaltic pump with plural drive means for improved pump tube life and greater pump accuracy, comprising:

a backplate;

replaceable pump tubing means disposed adjacent said backplate for passing fluid therethrough during pump operations;

rotatable support disc means, for rotating during pump operations, with a plurality of respectively rotatable pump roller means supported thereon such that the outside diameters of said pump roller means are extendable beyond the disc means outside diameter for pumping action engagement of said pump tubing means between said pump roller means and said backplate during pump operations;

primary drive means for selectively rotating said rotatable support disc means generally in a predetermined first rotatable direction; and secondary drive means for respectively rotating said pump roller means generally in a predetermined second rotatable direction opposite to that of said first rotatable direction, such that fluid received in said pump tubing means receives applied motion in said first rotatable direction, a radially outer point on said pump roller means outside diameters moving in said opposite second rotatable direction relative to said backplate and an adjacent point disposed on said pump tubing means, so as to reduce stretching of said pump tubing means.

9. A peristaltic pump as in claim 8, wherein:

said support disc means includes a plurality of respective support pins for receipt of said plurality of respective pump roller means; and said plurality of pump roller means comprise respective annular elements received on respective of said support pins, and having outside diameters sufficient such that a portion of each of said outside diameters projects beyond the outside diameter of said support disc means.

10. A peristaltic pump as in claim 9, wherein:

said primary drive means includes a central drive shaft associated with said support disc means, and motor means for selectively driving said central drive shaft; and said secondary drive means includes gear drive means associated with each respective pump roller means for rotating same.

11. A peristaltic pump as in claim 10, wherein said gear drive means includes a relatively larger, fixed gear ring, and a respective plurality of spur gears associated with each pump roller means, with said spur gears operatively associated with said gear ring, such that rotation of said central drive shaft results in desired respective rotation of said pump roller means.

12. A peristaltic pump as in claim 8, wherein said replaceable pump tubing means comprises a length of resilient tubing having respective input and output ends, and an intermediate section adapted to interface with said pump roller means for the advancement of fluid received therein.

13. A peristaltic pump as in claim 8, wherein said motion applied in said opposite second rotatable direction is about 5 to 10 percent greater than said motion applied in said first rotatable direction.

14. An improved peristaltic pump, providing prolonged pump tube life and improved fluid delivery rate accuracy, comprising:

at least one replaceable length of resilient and pliable pump tubing, through which fluids are to be advanced in a predetermined first direction by operation of said pump, said pump tubing having respective input and output ends, and having an intermediate position between said ends adapted to be engaged for fluid advancement;

upper and lower support discs mounted respectively generally in parallel on a central pump drive shaft adapted to be rotatably driven in said predetermined first direction;

a plurality of support pins received between said support discs and relatively spaced generally equidistantly about a support pin circle generally concentric with and adjacent to the outside diameters of said discs;

a corresponding plurality of generally circular pump rollers received respectively on said support pins, and having respective diameters sufficient such that portions of each of the respective outside diameters project beyond the outside diameters of said support discs;

a main pump body, including a rotatable pump drive motor means coupled with said central pump drive shaft for rotating same;

a generally rigid curved backplate, having a generally semi-circular concave curvature situated relatively-adjacent to said outside diameter of said discs, and separated a predetermined curved distance therefrom so as to form a predetermined curved gap between said concave curvature and the outside diameters of said pump rollers for receipt of said intermediate portion of said pump tubing, with respective fluid entrapment areas of said tubing being formed between adjacent respective pairs of said pump rollers in contact with said tubing;

an internal ring gear relatively fixedly mounted on said main pump body, having a plurality of inside diameter gear teeth, and having a total inside diameter greater then the diameter of said support pin circle; and a corresponding plurality of spur gears mounted respectively with said pump rollers, and each having outside diameter gear teeth positioned to mesh with said ring gear inside diameter gear teeth such that said respective pump rollers are rotatably driven about their respective support pins in a second direction generally opposite to that of said predetermined first direction whenever said pump drive motor means rotates said central pump drive shaft in said predetermined first direction;

whereby fluid in said intermediate portion of said tubing is advanced in said predetermined first direction while an opposite direction force is applied to said tubing to reduce undesired stretching of said resilient tubing due to relative motion of a radially outer portion of said pump roller diameters in said second direction relative to said backplate and adjacent point disposed on said tubing.

15. A pump as in claim 14, wherein the size of said curved gap is adjustable.

16. A peristaltic pump as in claim 14, wherein said radially outer porions of said pump roller diameters are driven in said second direction about 5 to 10 percent faster than in said first direction.

17. Methodology for improved pump tube life and pump fluid delivery rate accuracy for a peristaltic pump of the type having at least one replaceable pump tube, entrained about a plurality of pump rollers mounted on respective pins supported between upper and lower roller discs mounted for drivable rotation, and with said tube situated in a gap formed with an adjacent curved, relatively fixed backplate, said methodology including driving said pump rollers for rotation about their respective pins in a rotational direction opposite to that in which said roller discs are driven during operation of said pump, so that one direction of motion is applied to fluid received in said tube and so that the net resulting tangential motion of a radially outer point on each of said roller discs is in said opposite direction relative to said backplate and an adjacent point disposed on said tube.

18. A method as in claim 17, including providing a relatively fixed ring gear with inside diameter gear teeth operatively engaged with outside diameter gear teeth of a plurality of spur gears respectively operatively associated with said pump rollers, such that rotation of said roller discs in one direction results in rotation of said pump rollers in the opposite direction about their respective pins.

19. A method as in claim 17, wherein the number of said plurality of pump rollers of said peristaltic pump includes from 4 to 12 pump rollers, inclusive.

20. A method as in claim 17, wherein said at least one replaceable pump tube of said peristaltic pump is comprised of one of silicone, fluoropolymer, and vinyl materials.

21. A method as in claim 17, wherein said motion applied in said opposite direction is about 5 to 10 percent greater than said motion applied in said one direction.

22. A peristaltic pump for pumping fluid through pump tubing compressed against a backplate comprising:

a rotatable shaft;

a roller support mechanism mounted for rotation with said shaft;

a drive motor for rotating said shaft in a defined forward rotatable direction;

a plurality of support pins mounted to said roller support mechanism;

a plurality of pump rollers, each of said pump rollers mounted for rotation about a respective one of said support pins, said pump rollers compressing the pump tubing against the backplate to pump the fluid in said forward rotatable direction during rotation of said shaft;

a gear train drivingly connecting said shaft and said pump rollers to rotate said pump rollers in a defined rearward rotatable direction, said drive motor rotating both said roller support mechanism and said pump rollers with a net resulting tangential motion at a radially outer point on each of said pump rollers in said rearward direction.

23. A peristaltic pump as in claim 22, wherein said net resulting tangential motion occurs at a speed of 5 to 10 percent of the tangential speed of said radially outer point due to the rotation of said roller support mechanism around said shaft.

* * * * *